United States Patent [19]

Dobśa et al.

[11] Patent Number: 4,581,573

[45] Date of Patent: Apr. 8, 1986

[54] STATIC CONVERTER TRANSFORMER WITH HARMONIC FILTER

[75] Inventors: Josip Dobśa, Oberrohrdorf; Gerhard Linhofer, Baden, both of Switzerland

[73] Assignee: BBC Brown, Boveri & Company, Limited, Baden, Switzerland

[21] Appl. No.: 589,180

[22] Filed: Mar. 13, 1984

[30] Foreign Application Priority Data

Jan. 13, 1984 [CH] Switzerland ..... 160/84

[51] Int. Cl.[4] ..... H01F 27/42

[52] U.S. Cl. ..... 323/356; 336/69; 363/35

[58] Field of Search ..... 307/82, 83, 105; 323/356, 361; 336/69; 363/3, 4, 5, 7, 35, 40, 44, 46, 47, 48, 51, 64, 68, 71, 154, 155

[56] References Cited

U.S. PATENT DOCUMENTS

| | | | |
|---|---|---|---|
| 4,053,820 | 10/1977 | Peterson et al. | 363/48 |
| 4,224,660 | 9/1980 | Mohan | 363/35 |
| 4,308,575 | 12/1981 | Mase | 363/48 |

OTHER PUBLICATIONS

"Solid State Converters at Eel River Give Satisfactory Performance"; Ryder; Electrical Review; Sep. 1972.

Happoldt et al., "Elektrische Kroftwerke und Netze" 5th Edition, pp. 612–614, Springer-Verlag Berlin, Heidelberg, New York 1978.

Blume et al., "Transformer Eengineering", pp. 122 and 123, New York (1938).

*Primary Examiner*—William H. Beha, Jr.
*Assistant Examiner*—Jeffrey Sterrett
*Attorney, Agent, or Firm*—Burns, Doane, Swecker & Mathis

[57] ABSTRACT

A better filtering effect for disturbing harmonic currents in a high-tension direct current transmission installation is described. A balancing winding is provided between a primary winding as an outer winding and a secondary winding in a 3-winding transformer with a transformer core. The distances between the balancing winding and the primary winding and the secondary winding, respectively, are selected such that the equivalent reactance of this balancing winding is equal to or less than zero. A second balancing winding can be provided as the inner winding in a series with the first balancing winding. In the case of a 4-winding transformer, two winding arrangements are provided with two parallel-connected primary windings as the outer windings, with a separate secondary winding for each and a balancing winding for each between the primary and secondary windings, the two balancing windings being connected in series.

4 Claims, 4 Drawing Figures

STATIC CONVERTER TRANSFORMER WITH HARMONIC FILTER

Figure 1:
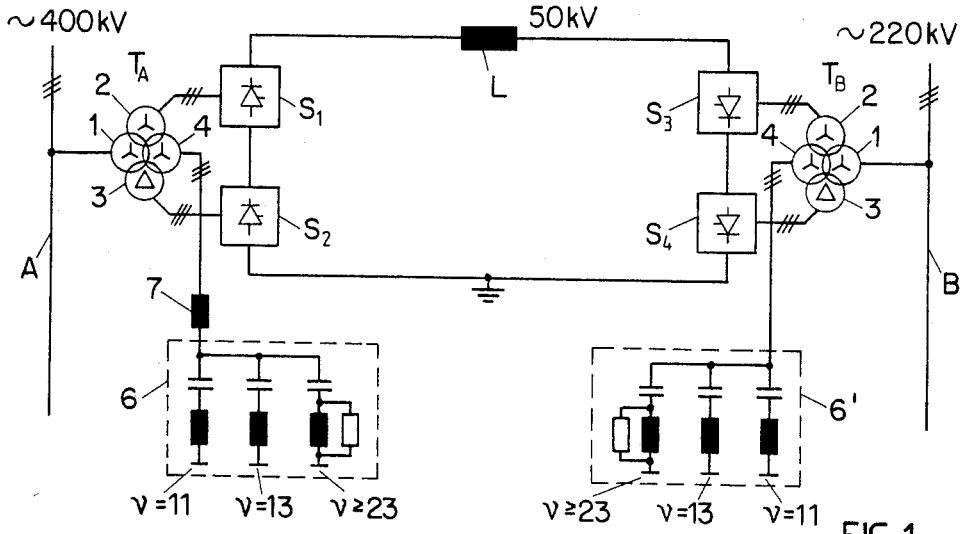

This invention relates to static converter transformers, and more particularly to transformers for high-tension direct current transmission.

The present invention relates to static converter transformers such as are presented and described in the book: H. Happoldt, D. Oeding, Elektrische Kraftwerke und Netze [Electric power stations and grids], 5th Edition, Springer-Verlag Berlin Heidelberg N.Y., 1980, pp. 612–614. FIGS. 19.4 and 19.5 of this book show 3-winding and 4-winding transformers of a high-tension direct current transmission installation, referred to below as HDT, in which one or two secondary windings of the transformer are connected to alternating current inputs of static converters. A tertiary or balancing winding is connected to filter absorption circuits for harmonic currents or to generators which supply the necessary wattless power for the static converters. On pages 172–175 of this book, an example is described of a 3-winding transformer for feeding electrical energy from a 110 kV grid into 10 kV and 30 kV grids with steady and unsteady consumer loads, in which transformer the primary winding is located between two secondary windings. Equations are there given for the determination of the short circuit impedances from the voltage, throughput power and nominal short circuit voltage. In a calculated example, the reactance of the primary winding is negative while the reactances of the two secondary windings are approximately equal to the short circuit reactances between them and the central winding.

The static converters of an HDT generate harmonic currents. If these flow freely into the three-phase current grid, voltage distortions occur therein. In order to prevent this, filter circuits (absorption circuits) are connected to the three-phase current busbar in parallel to the static converter transformers. These filter circuits are so dimensioned that they have a very small impedance for certain dominantly occurring harmonics and therefore form a short circuit path for the harmonic currents.

The effect is that the harmonic currents flow mainly into the filter circuits and the harmonic loading on the grid is therefore kept small.

If HDT's of small power are connected to three-phase current busbars at high voltage, then the filter circuits also have to be connected to this high voltage. Very high specific costs arise for the filter circuits. In order to reduce these costs, the filter circuits are connected to an additional winding of the static converter transformers, this winding being dimensioned for a low voltage. A disturbing feature of this arrangement is the residual impedance of the balancing winding, which detunes the filter circuits and therefore reduces their effect.

Accordingly, the object of the invention is to obtain, using simple means, better filtering of disturbing harmonic currents generated by consumer loads, in particular by static converters.

One advantage of the invention is that harmonic voltages in the alternating current grids are reduced and, therefore, undesirable distortions of the grid voltage and telephone interference are avoided. By a suitable winding arrangement, the equivalent reactance on the filter side relative to an imaginary mid-point of the equivalent reactances can be made negative or as near as possible to zero. If an equivalent reactance is equal to zero, the connected filter circuits are not detuned. If the equivalent reactance is not equal to zero, it is possible, in accordance with an advantageous embodiment of the invention, to connect an additional choke between the balancing winding and the filter circuit so that the latter is not detuned. The filter absorption circuit choke of the filter circuit connected to the static converter transformer can be advantageously so dimensioned that the additional choke is obviated. Particularly advantageous is the use of a 4-winding transformer for 12-pulse static converter operation, for which the filter circuit has to be designed, in the main, only for filtering out the 11th and 13th harmonics.

Figure 3:
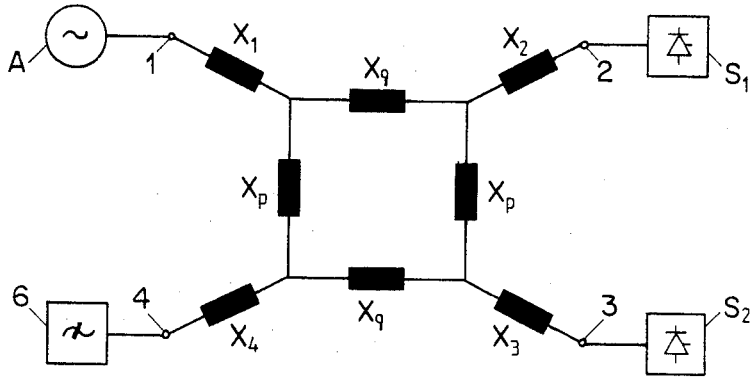
Figure 2:
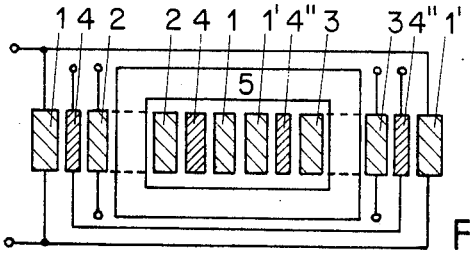
Figure 5:
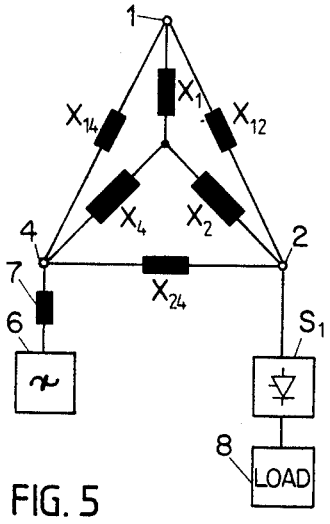
Figure 4:
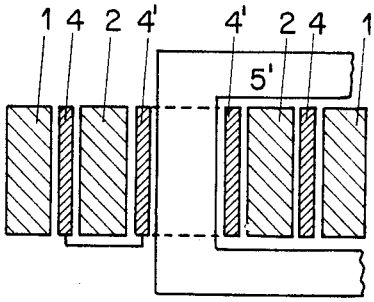

The invention is described below using two embodiment examples. In the drawing:

FIG. 1 shows a basic circuit diagram of an HDT with rectifier station and inverse rectifier station having static converter transformers in accordance with the invention, FIG. 2 shows a transformer with a 4-winding arrangement, FIG. 3 shows a reactance equivalent circuit diagram for a transformer in accordance with FIG. 2, FIG. 4 shows a transformer with a 3-winding arrangement and FIG. 5 shows a reactance equivalent circuit diagram for a transformer in accordance with FIG. 4.

In FIG. 1, A indicates a 400 kV three-phase current grid and B indicates a 220 kV three-phase current grid which is connected to the three-phase current grid A via an HDT. Static converter transformers $T_A$ and $T_B$ transform the voltages present in the three-phase current grids A and B in static converters $S_1$, $S_2$ and $S_3$, $S_4$, respectively, to a value of 50 kV suitable for direct current coupling. The static converters $S_1$ and $S_2$ on the transmission side operate as rectifiers; they extract real power from the three-phase current grid A and supply it to the direct current side. The static converters $S_3$ and $S_4$ on the reception side operate as inverse rectifiers; they take up the direct current power carried by the direct current line and supply it as real power to the three-phase current grid B. At least one smoothing choke L is provided in the direct current circuit. The static converter transformers $T_A$ and $T_B$ each have a primary or high-tension winding 1, two secondary or rectifier windings 2, 3 and a tertiary or balancing winding 4. The primary windings 1 of the static converter transformers $T_A$ and $T_B$ are connected to the appropriate three-phase current grid A or B, the secondary windings 2 and 3 to the alternating current inputs of the static converters $S_1$ and $S_2$ or $S_3$ and $S_4$. The balancing windings 4 of the static converter transformers connected in parallel on the transmission side are connected via at least one additional choke 7 to a filter circuit 6 with filter absorption circuits for harmonic currents of order $\nu=11$ and $\nu=13$ and $\nu\geqq 23$. In the reception station, the two balancing windings 4 are also connected to a filter circuit 6'. In this case, there are no additional chokes for connection to the filter circuit 6' because they are either not necessary due to the construction of the static converter transformer $T_B$ or have been taken into account in dimensioning the absorption circuit chokes.

Two or more static converter transformers with valve and filter circuits can also be connected in parallel per static converter station. The balancing windings 4 of the static converter transformers can then be connected to one another. Because of the symmetrical construction, the transmission and reception sides can be exchanged with one another.

The winding arrangement of the cylindrical windings of the static converter transformers $T_A$, $T_B$ in accordance with FIG. 1 can be seen in FIG. 2 for one alternating current phase. About each limb of a transformer core 5 is located a primary winding 1 and 1' as the outer winding, a secondary winding 2 and 3 as the inner winding and a balancing winding 4 and 4'' between the outer and inner windings. The two primary windings 1 and 1' are connected in parallel, the two balancing windings 4 and 4'' are connected in series and the two secondary windings 2 and 3 are designed to be separate. The undesirable magnetic coupling of the secondary windings 2 and 3 is kept as small as possible by the location on two limbs.

An associated equivalent reactance circuit diagram for one alternating current phase is shown in FIG. 3 in which $X_1 \ldots X_4$ indicate equivalent reactances associated with the windings 1 . . . 4 of the static converter transformer $T_A$ or $T_B$, and $X_p$, $X_q$ are hypothetical filter coupling reactances. The dimensioning of the windings of the static converter transformer and their distances from one another should be so selected that the filter side equivalent reactance $X_4$ becomes O. On the subject of the relatively comprehensive equations for the calculation of $X_4$, reference should be made to the book: Transformer Engineering (a publication of the General Electric Company's engineers of the transformer engineering department), published by L. F. Blume, Wiley, N.Y. (1938) pp. 122 and 123.

FIG. 4 shows a 3-winding arrangement of the cylindrical windings for one alternating current phase in the case of a transformer. Located around a transformer core 5', shown in part, are—from the inside to the outside—a balancing winding 4', a secondary winding 2, a further balancing winding 4 and a primary winding 1. The two balancing windings 4 and 4' are connected in series.

In the associated equivalent reactance circuit diagram of FIG. 5, 8 indicates a consumer load which is connected to the secondary winding 2 via the static converter $S_1$. The filter circuit 6 is connected to the balancing winding 4 via the additional choke 7. $X_{12}$, $X_{24}$ and $X_{14}$ indicate reactances, which can be determined in known manner from measurements on the transformer between the windings 1, 2 and 4 and are usually quoted on the type plate of the transformer. Otherwise, the same parts are indicated by the same reference numbers in all the figures.

The transformer with a 3-winding arrangement is again to be dimensioned so that the equivalent reactance $X_4$ assumes the value 0 or a small negative value. In the latter case, an air-core choke with a (positive) reactance is then connected in series with the balancing winding 4 and, if appropriate, 4', which air-core choke is of the same magnitude as the negative equivalent reactance $X_4$. By this means, the reactance is brought to an imaginary mid-point of the reactances—seen from the filter connection point—and the filter effect is completely retained. $X_4$ can be calculated from:

$$X_4=(-X_{14}-X_{24}-X_{12})/2.$$

If 3-winding arrangement transformers are used instead of the 4-winding arrangement transformers $T_A$ and $T_B$ in an HDT in accordance with FIG. 1, the secondary windings 3 with the connected static converters $S_2$ and $S_4$ disappear.

When using a 3-winding arrangement transformer, the inner balancing winding 4' can be dispensed with and the condition required for the equivalent reactance $X_4$ can be obtained using the balancing winding 4 alone by suitable setting of the distances between the windings. However, two balancing windings 4 and 4' with the same number of turns should preferably be used.

It is self-evident that the invention is not restricted to 3-winding or 4-winding arranged transformers. In the case of 4-winding arrangement transformers, the two winding arrangements can be located one under the other on one limb instead of the two winding arrangements being located on two limbs.

We claim:

1. A static converter transformer for at least one phase of an alternating current, in particular for high-tension direct current transmission, comprising:

(a) a transformer core;

(b) at least two winding arrangements applied to the transformer core, each winding arrangement including a balancing winding;

(c) each winding arrangement having a primary winding as the outer winding;

(d) the primary windings being connected in parallel to one another;

(e) each winding arrangement having a separate secondary winding;

(f) the balancing windings being located between each primary winding and secondary winding and connected in series;

(g) the distances between each balancing winding and the primary winding and between each balancing winding and the secondary winding being selected so that the equivalent reactance of each balancing winding is less than or equal to 0.

2. A static converter transformer in accordance with claim 1 in which (a) at least one balancing winding is in effective connection with a choke and (b) the reactance of this choke is equal in magnitude to the magnitude of the equivalent reactance of the balancing winding.

3. A static converter transformer in accordance with claim 1, further including at least one filter circuit which is operatively associated with the choke.

4. A static converter transformer for at least one phase of an alternating current, in particular for high-tension direct current transmission, of the type having a transformer core, about which is wound (a) at least one primary winding;

(b) at least one secondary winding; and (c) at least one balancing winding for the connection of at least one filter circuit, the improvement comprising:

(d) at least one part of the at least one balancing winding being located between one primary winding and one secondary winding;

(e) the distances between the balancing winding and the primary winding and between the balancing winding and the secondary winding being selected so that the equivalent reactance of this balancing winding is less than or equal to 0;

(f) an additional balancing winding;

(g) one part of the at least one balancing winding is located between the transformer core and the secondary winding; and (h) the part of the at least one balancing winding and the additional balancing winding are connected in series.

* * * * *